United States Patent [19]

Hurko

[11] Patent Number: 4,894,515

[45] Date of Patent: Jan. 16, 1990

[54] HOT PLATE FOR COOKING

[75] Inventor: Bohdan Hurko, Louisville, Ky.

[73] Assignee: The Kanthal Corporation, Bethel, Conn.

[21] Appl. No.: 720,733

[22] Filed: Apr. 8, 1985

[51] Int. Cl.[4] ..... H05B 3/68; F24H 9/02

[52] U.S. Cl. ..... 219/345; 219/463; 219/464

[58] Field of Search ..... 219/345, 458, 459, 460, 219/461, 462, 463, 464, 465, 467, 541; 338/278, 279, 282, 296, 297

[56] References Cited

U.S. PATENT DOCUMENTS

| | | | |
|---|---|---|---|
| 3,758,750 | 9/1973 | VanToorn | 219/464 X |
| 4,221,672 | 9/1980 | McWilliams | 219/464 X |
| 4,262,192 | 4/1981 | Giler | 219/464 X |
| 4,508,961 | 4/1985 | McWilliams | 219/464 X |

FOREIGN PATENT DOCUMENTS

| | | | |
|---|---|---|---|
| 2165569 | 7/1979 | Fed. Rep. of Germany | 219/464 |

*Primary Examiner*—Timothy V. Eley
*Attorney, Agent, or Firm*—Kenyon & Kenyon

[57] ABSTRACT

A hot plate formed by a hub from which spokes radially extend in a horizontal plane, the spokes being formed by flat strips of refractory fibrous or woven material, each positioned in a vertical plane and having upper edges in which downwardly extending notches are formed, and molybdenum disilicide wire in the form of a flat spiral having convolutions with portions inserted in the slots, the wire having terminating ends, and means for connecting the ends with electric current.

11 Claims, 4 Drawing Sheets

HOT PLATE FOR COOKING

BACKGROUND OF THE INVENTION

This invention relates to hot plates for cooking and particularly the type comprising a shallow sheet metal cup containing a ceramic support positioning a horizontal flat spiral of electric resistance heating wire which when supplied with current produces heat. Such hot plates are used under the bottoms of the glass plates of glass top cooking ranges.

Hot plates particularly when installed in glass top ranges have used metal alloy electric resistance wire as a heating element. The metal alloy wire is elastic at room temperature and is not easily damaged by rough handling of the hot plate such as occurs during shipment and installation in the range. On the other hand, it is slow to heat and cool and operates at low efficiency because the heat is transmitted to cooking utensils on the glass top largely by convection to the glass. Metal alloy resistance heating wire operates at usual temperatures between 1500° F. and 2100° F. and has a maximum operating temperature of 2200° F. At these temperatures the metal wire heat radiation is low. Public reaction against the low efficiency and slow heating and cooling of glass top electric ranges have resulted in some loss of their initial popularity.

Recent development of ceramic glass with a high transmittance of infrared radiation in the range of 0.6 to 4.5 microns wavelength has not helped in solving the above indicated problem, because at the operating temperature range of metal alloy resistance wire there is only a small amount of heat radiation provided for transmittance through the high transmittance glass if it is applied as a glass top range installation.

The high transmittance glass would have a great advantage if the heating element could be operated at the high temperatures where the heat radiation becomes substantial. For example, at 2800° F. the wire heat radiation would become more than twice that at the 2200° F. maximum operating temperature of metal alloy wire. The heat radiation at 2200° F. is only 44.3% of that obtained at 2800° F., and at the more usual metal wire operating temperature of 1500° F. the heat radiation is only 13.1% of that provided at 2800° F.

If the metal alloy wire is replaced by molybdenum disilicide ($MoSi_2$) wire the operating temperature of 2800° F. becomes possible without requiring protection from the ambient atmosphere. The prior art has made efforts to develop a hot plate using $MoSi_2$ wire as the heating element, because of its apparent advantages.

Unfortunately, at room temperature $MoSi_2$ wire is glasslike and very brittle and is easily broken by the shock of rough handling such as occurs during hot plate shipping and installation in a glass top range. This has so far prevented commercial production of hot plates using $MoSi_2$ heating elements.

The object of the present invention is to provide a hot plate using a $MoSi_2$ wire heating element and which solves the prior art wire breakage problem that has prevented commercialization of $MoSi_2$ hot plates.

SUMMARY OF THE INVENTION

Briefly stated, to achieve the above object, this invention is a hot plate formed basically by a refractory hub from which spokes radially extend in a horizontal plane, the spokes being formed by refractory flat strips of paper made from refractory fibers, cloth woven from refractory filiments and possibly stiffened by refractory material, and the like. The strips are positioned in a vertical plane and have upper edges in which downwardly extending notches are formed, the $MoSi_2$ wire being in the form of a flat spiral having convolutions with portions inserted in the slots of the strips. The wire of course has terminating ends and means for connecting these ends with electric current.

The refractory strip spokes should be stiff enough to support the wire but soft enough to absorb the transmission of mechanical shock to the wire. When encased by refractory material in an open top sheet metal cup the hot plate can be roughly handled without breakage of the $MoSi_2$ wire to a degree making the hot plate commercially practical for sale and use. Details are disclosed below.

DESCRIPTION OF THE DRAWINGS

The accompanying drawings show one presently preferred form of the invention, the various figures being as follows.

Figure 4:
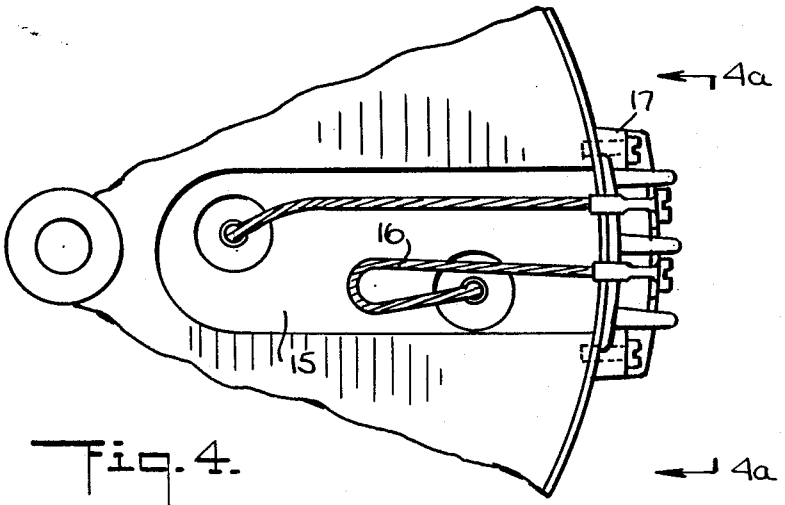
FIG. 4 is a plan view showing a segment of the bottom of the hot plate and looking upwardly.
Figure 3:
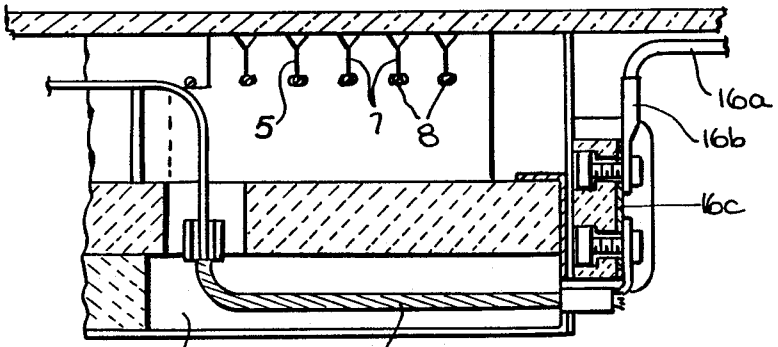
FIG. 3 is a segmental vertical cross section taken on the line 3—3 in FIG. 1.
Figure 4A:
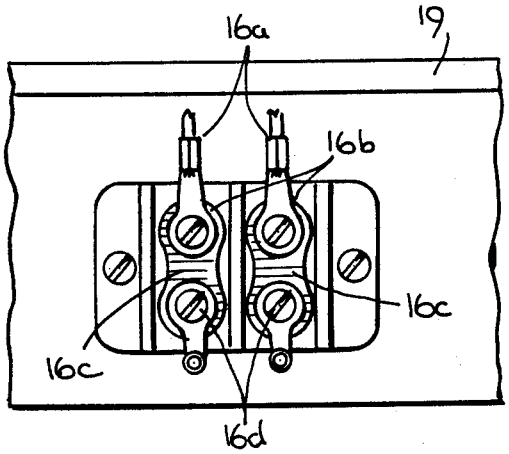
Figure 5:
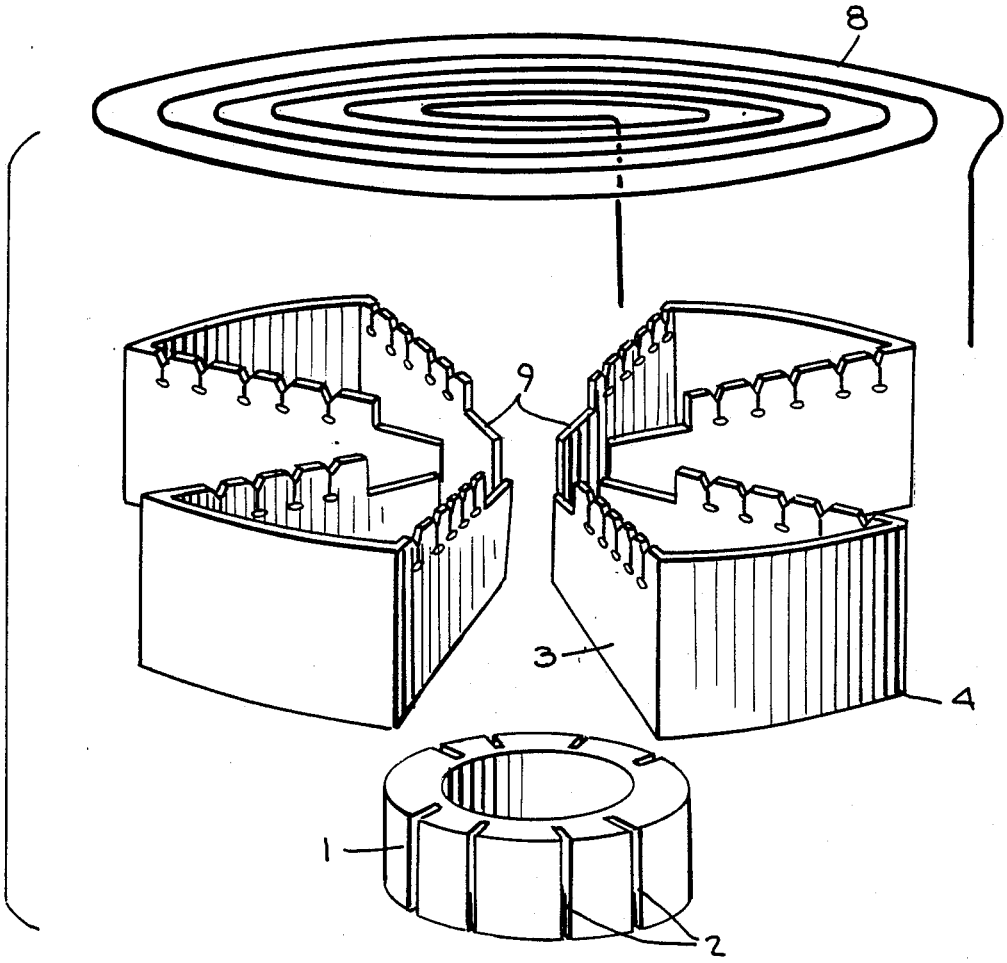
Figure 6:
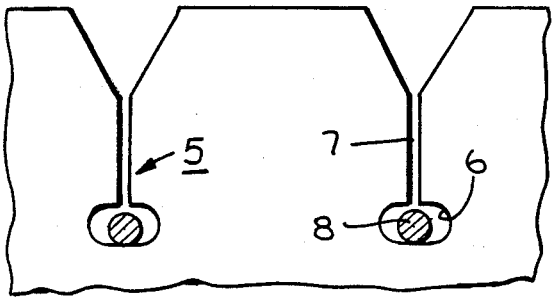

FIG. **4*a* is a side view of FIG. 4, taken on the line 4*a*–4*a* in FIG. 4**;

FIG. 5 is an exploded view showing in perspective how the hot plate parts are assembled; and FIG. 6 is a segment showing in elevation the $MoSi_2$ wire after insertion in the paper slits.

DETAILED DESCRIPTION OF THE DRAWINGS

The refractory hub 1 is shown as being in the form of a cup which can be made of rigid or semi-rigid ceramic material and is formed with a circumferential series of interspaced vertical slots 2 as illustrated particularly well by FIG. 5. The refractory strip spokes are formed as pairs of two spokes each as shown by FIG. 5, by a single length of the strip folded to form the spokes 3 joined together by arcuate back portions 4, their radially inner ends being inserted in the slots 2 of the hub 1. Suitable refractory strip material is commercially available as Fiberfax paper or paper board by the Carborundum Company, Ceramic paper available from the Cortronics Company, or Kaowool paper or Vertel ceramic fiber woven tape and fabric, possibly rigidized by Babcox and Wilcox "3000" material which can be used up to a temperature of 3000° F.

The upper edges of all of the spokes, of which eight are shown, are formed with the slots 5 having V-shaped upper portions and horizontally elongated lower portions 6, these portions being interjoined by slits 7. The flat horizontal spiral of $MoSi_2$ wire 8 has its portions registering with the slots pressed downwardly through the slits 7 so as to nest in the portions 6, the slits 7 pressing open to permit the passage of the wire and therefore reclosing completely or substantially so. The interspacing of the slots radially along the spokes 3 is mad to match the pitch of the wire spiral 8 keeping in mind that the $MoSi_2$ wire when cold is brittle and glass-like and should be free from mechanical stress both during and after insertion in the slots of the spokes. The $MoSi_2$ wire is ductile at high temperatures, permitting its formation into the spiral, but it is very brittle when cold.

The radial interspacing of the wire convolutions is kept as uniform as possible and this may require the elimination of the slots close to the axis of the spiral, leaving flat shelves 9 on which the innermost convolution rests. This convolution is of small diameter and does not require positive positioning in the radial direction.

Figure 1:
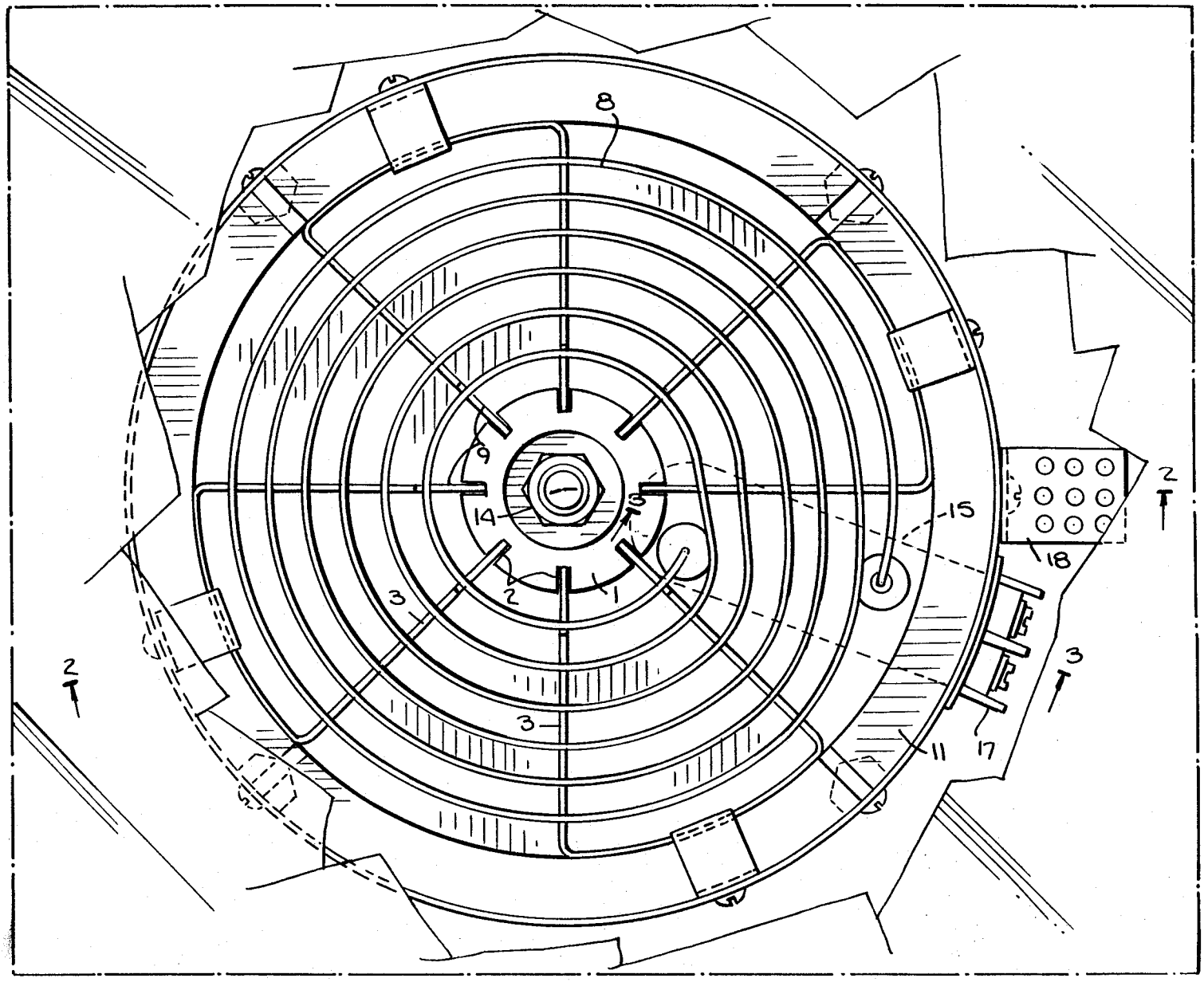
FIG. 1 is a top plan view of the hot plate.
Figure 2:
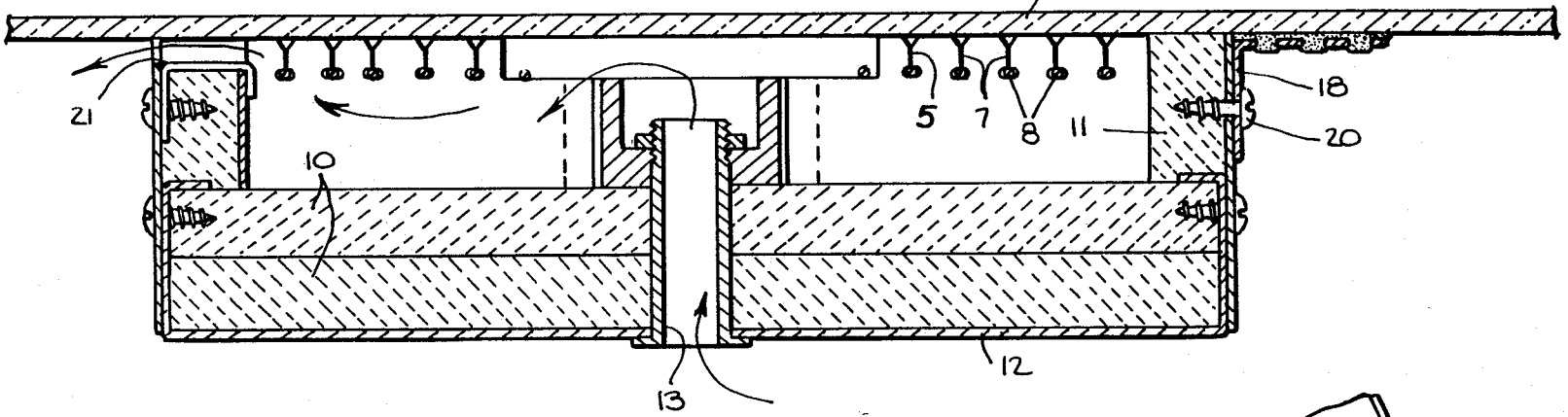
FIG. 2 is a vertical cross section taken on the line 2—2 in FIG. 1.

FIGS. 1 and 2 show the heat element and strip assembly with the strip spokes having their bottom edges resting on a plate formed by relatively soft fibrous flat refractory discs 10 and circumferentially encircled by a soft fibrous refractory ring 11, these fibrous parts being encased by a shallow sheet metal cup 12. The hub or center post 1 is rigidly positioned by a tubular bolt 12 which extends through the cup bottom, the discs 10 and the bottom of the hub 1, a nut 13 being screwed on the bolt 12 and against the bottom of the cup-shaped hub 1 so as to fix the latter rigidly in position. The flat disc or plate rests flatly on the flat bottom wall of the cup so a firm assembly is obtained.

The terminating ends of the $MoSi_2$ wire spiral extend downwardly through the upper one of the discs 10 and into a pocket 15 formed in the lower one of the discs and in which the terminating ends **8*a* are connected via flexible wire 16 with a terminal block 17 on the outside of the wall of the sheet metal cup or casing. The wires 16 should be flexible enough to prevent the transmission of mechanical motion or shock from the terminal 17 to the terminating ends of the $MoSi_2$ wire. Preferably the wires 16 are stranded from fine wires for maximum flexibility and are of substantial length for great flexibility, their outer ends 16*a* having terminals 16*b* screwed to flat conductor strip 16*c*** on the terminal block. All of these parts are installed at the heater factory so that the unit as a whole can be roughly handled without damage to the MoSi*2* wire. The terminal block has screw terminals **16*d*** permitting installation at the stove factory.

Prior art hot plates have been installed in glass top ranges by being spring pressed against the bottom of the glass plate top. With the inherent flexibility of the glass restrained in this manner the glass tops have had a tendency to break under the impact of a carelessly placed cooking utensil.

In the present case the hot top is installed by being provided with brackets 18 of which there are 3 although only one is shown in the drawings. These brackets are adhesively secured to the bottom of the glass plate 19 so that the hot plate is supported entirely by the glass plate. The brackets can be releasably connected to the hot plate by releasable screws 20, permitting removal of the hot plate for servicing. In a typical range there would be four of these hot plates, possibly of different diameters. With the glass plate 19 forming the glass top of the range and mounted as usual only by its periphery, the inherent flexibility of the glass is retained so that it is better able to absord downward shock.

If instead of a full range installation the new hot plate is to be used as a small single or double heating element unit, it should still use a glass plate cover for protection of the $MoSi_2$ wire against mechanical damage by dropped objects for example. Also, the glass plate holds down the spokes which are $MoSi_2$ wire owes its ability to operate at very high temperatures to the formation of a silica or glass-like layer on its surface when exposed to oxygen at the high temperatures. To assure a supply of oxygen, at various circumferentially spaced locations around the side wall of the cup 12, openings 21 are formed through the side wall and the fibrous ring 11. Therefore, when the heating element is operated air is sucked in through the hollow bolt 12 and over the top edge of the cup-like hub 1 so as to flow around the wire convolution and exit through the exhause opening 21. If during initial heating of the element a slight deposit is thrown off it will be carried away by the air flow so as not to contaminate the bottom of the glass plate.

It can be seen that the brittle and rather fragile $MoSi_2$ wire spiral is positively held in position but only by the shock absorbing strip spokes, themselves protected against shock by the fibrous discs or plates 10 and the fibrous ring 11 encircling the radially outward ends of the strips. Shocks from rough handling are not transmitted to the heating element.

$MoSi_2$ wire has its lowest electrical resistivity when cold. Therefore, the instant current is applied to the heating element via the terminals 17, it immediately lights up to its incandescent state providing the 2800° F. operating temperature producing a large amount of heat in the form of radiation. Assuming the glass plate 19 is made of the high transmittance glass a cooking utensil is heating very largely directly by radiation. Also, $MoSi_2$ wire has a very low thermal mass and stores very little energy, so it drops quickly below incandescense when the current is discontinued.

A glass top electric range using these new hot plates, not only provides high efficiency but a spectacular performance capability. When a hot plate is switched on incandescense is immediately obtained and when switched off the incandescense is immediately terminated.

The strips used are relatively thin and can have a thickness only sufficient for structural stability of the wire element. They can be cut from wider material if necessary. The strips can be said to be made of refractory fibers as in the case of paper, or as woven from refractory threads. An optimum balance between softness and stiffness should be the objective.

Possibly resistance wire other than $MoSi_2$ may be developed, having the high temperature operating capability and the cold-brittle characteristics of the $MoSi_2$ wire. If so, such wire is considered to be an equivalent of $MoSi_2$ wire.

What is claimed is:

1. A hot plate comprising a hub from which spokes radially extend in a horizontal plane, the spokes being formed by refractory fibrous or woven flat strips each positioned in a vertical plane and having upper edges in which downwardly extending notches are formed, and molybdenum disilicide wire in the form of a flat, spiral having convolutions with portions inserted in the notches, the wire having terminating ends, and means for connecting the ends with electric current.

2. The hot plate of claim 1 in which said strips have lower edges, and there is a flat plate on which the lower edges rest, said strips being stiff so as to support said convolutions but soft enough to absorb the transmission of mechanical shock from the plate to the convolutions.

3. The hot plate of claim 2 in which said notches are in the form of slits extending downwardly from said upper edges to openings in said strips and which are horizontally elongated and in which said portions of said convolutions are positioned.

4. The hot plate of claim 3 in which said strips are soft enough to permit said convolution portions to be pushed downwardly through said slits and into said openings during assembly of the hot plate.

5. The hot plate of claim 2 in which said flat plate is formed by refractory fibrous material.

6. A hot plate comprising a hub from which spokes radially extend in a horizontal plane, the spokes being formed by refractory fibrous or woven flat strips each positioned in a vertical plane and having upper edges in which downwardly extending notches are formed, and molybdenum disilicide wire in the form of a flat spiral having convolutions with portions inserted in the notches, the wire having terminating ends, and means for connecting the ends with electric current; said strips having lower edges, and there is a flat plate on which the lower edges rest, said strips being stiff so as to support said convolutions but soft enough to absorb the transmission of mechanical shock from the plate to the convolutions; said notches being in the form of slits extending downwardly from said upper edges to openings in said strips and which are horizontally elongated and in which said portions of said convolutions are positioned; said strips being soft enough to permit said convolution portions to be pushed downwardly through said slits and into said openings during assembly of the hot plate said strips having radially inner ends and said hug having vertical slots in which the inner ends are positioned.

7. The hot plate of claim 6 in which each two of said spokes is formed by a single length of said strip having outer ends joined together circumferentially by an arcuate section of the strip.

8. A hot plate comprising a hub from which spokes radially extend in a horizontal plane, the spokes being formed by refractory fibrous or woven flat strips each positioned in a vertical plane and having upper edges in which downwardly extending notches are formed, and molybdenum disilicide wire in the form of a flat spiral having convolutions with portions inserted in the notches, the wire having terminating ends, and means for connecting the ends with electric current; said strips having lower edges, and there is a flat place on which the lower edges rest, said strips being stiff so as to support said convolutions but soft enough to absorb the transmission of mechanical shock from the plate to the convolutions; said flat plate being formed by refractory fibrous material; said strips having radially outer ends and a sheet metal cup has a side wall encircling and enclosing the outer ends; said flat plate and the cup having flat interengaging surfaces, and a cylinder of refractory material being interposed between and contacted by the strips outer ends and the cup's side wall.

9. The hot plate of claim 8 in which said cup has a rim and the rim and the upper edges of said strips are covered by a glass plate.

10. The hot plate of claim 9 in which said rim has releasably connnected brackets adhesively fixed to the glass plate so as to solely thereby support the hot plate.

11. The hot plate of claim 8 in which said flat plate has a recess formed upwardly in its bottom and said terminating ends extend downwardly through the flat plate and into the recess and connected to flexible wires stranded from fine wire, the flexible wire extending through said cylinder of refractory material and the cup's said side wall to a terminal block fixed to the outside of the side wall and having terminal screws for connection to a power line, said flexible wires having terminating ends electrically connected to the terminal screws.

* * * * *